US011355853B2

(12) United States Patent
Hsu et al.

(10) Patent No.: US 11,355,853 B2
(45) Date of Patent: Jun. 7, 2022

(54) ANTENNA STRUCTURE AND WIRELESS COMMUNICATION DEVICE USING THE SAME

(71) Applicant: Chiun Mai Communication Systems, Inc., New Taipei (TW)

(72) Inventors: Cho-Kang Hsu, New Taipei (TW); Min-Hui Ho, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 99 days.

(21) Appl. No.: 16/868,394

(22) Filed: May 6, 2020

(65) Prior Publication Data

US 2020/0358198 A1 Nov. 12, 2020

(30) Foreign Application Priority Data

May 9, 2019 (CN) ..... 201910385886.9

(51) Int. Cl.

| | |
|---|---|
| ***H01Q 13/10*** | (2006.01) |
| ***H01Q 1/24*** | (2006.01) |
| ***H01Q 5/335*** | (2015.01) |
| ***H01Q 1/48*** | (2006.01) |

(52) U.S. Cl.

CPC ..... *H01Q 13/10* (2013.01); *H01Q 1/243* (2013.01); *H01Q 1/48* (2013.01); *H01Q 5/335* (2015.01)

(58) Field of Classification Search

CPC ..... H01Q 1/243; H01Q 13/10; H01Q 5/335

See application file for complete search history.

(56) References Cited

U.S. PATENT DOCUMENTS

| | | | | |
|---|---|---|---|---|
| 10,389,010 | B2 * | 8/2019 | Lee | H01Q 5/335 |
| 10,804,595 | B2 * | 10/2020 | Chang | H01Q 5/335 |
| 2017/0048363 | A1 * | 2/2017 | Lee | H04B 1/3833 |
| 2018/0261921 | A1 * | 9/2018 | Ha | H01Q 9/045 |
| 2019/0214714 | A1 * | 7/2019 | Chen | H01Q 5/371 |
| 2020/0358198 | A1 * | 11/2020 | Hsu | H01Q 1/243 |

FOREIGN PATENT DOCUMENTS

| | | |
|---|---|---|
| CN | 205543232 U | 8/2016 |
| CN | 208674363 U | 3/2019 |

* cited by examiner

*Primary Examiner* — Dameon E Levi
*Assistant Examiner* — Jennifer F Hu
(74) *Attorney, Agent, or Firm* — ScienBiziP, P.C.

(57) ABSTRACT

An antenna structure with wide bandwidth in a reduced physical space includes a housing, a side wall, and a first feed portion. The housing includes a metal side frame, a metal middle frame, and a metal back board. The side wall is made of metal material. The metal middle frame and the metal back board are coupled to two sides of the side wall, and the metal middle frame is parallel to the metal back board. The metal side frame surrounds the metal back board. The metal side frame defines at least one gap. The metal back board defines a slot. The slot and the at least one gap cooperatively divide at least two radiation portions from the metal side frame. A wireless communication device employing the antenna structure is also provided.

19 Claims, 15 Drawing Sheets

ANTENNA STRUCTURE AND WIRELESS COMMUNICATION DEVICE USING THE SAME

FIELD

The subject matter relates to antennas.

BACKGROUND

Wireless communication devices becoming lighter and thinner reduce the area of an antenna substrate. With the continuous development of the wireless communication technology, the bandwidth requirement of antennas is constantly increasing. Therefore, designing an antenna with a wide bandwidth in a limited space is an important issue.

Therefore, there is a room for improvement.

BRIEF DESCRIPTION OF THE DRAWINGS

Implementations of the present disclosure will now be described, by way of embodiments, with reference to the attached figures.

DETAILED DESCRIPTION

Figure 1:
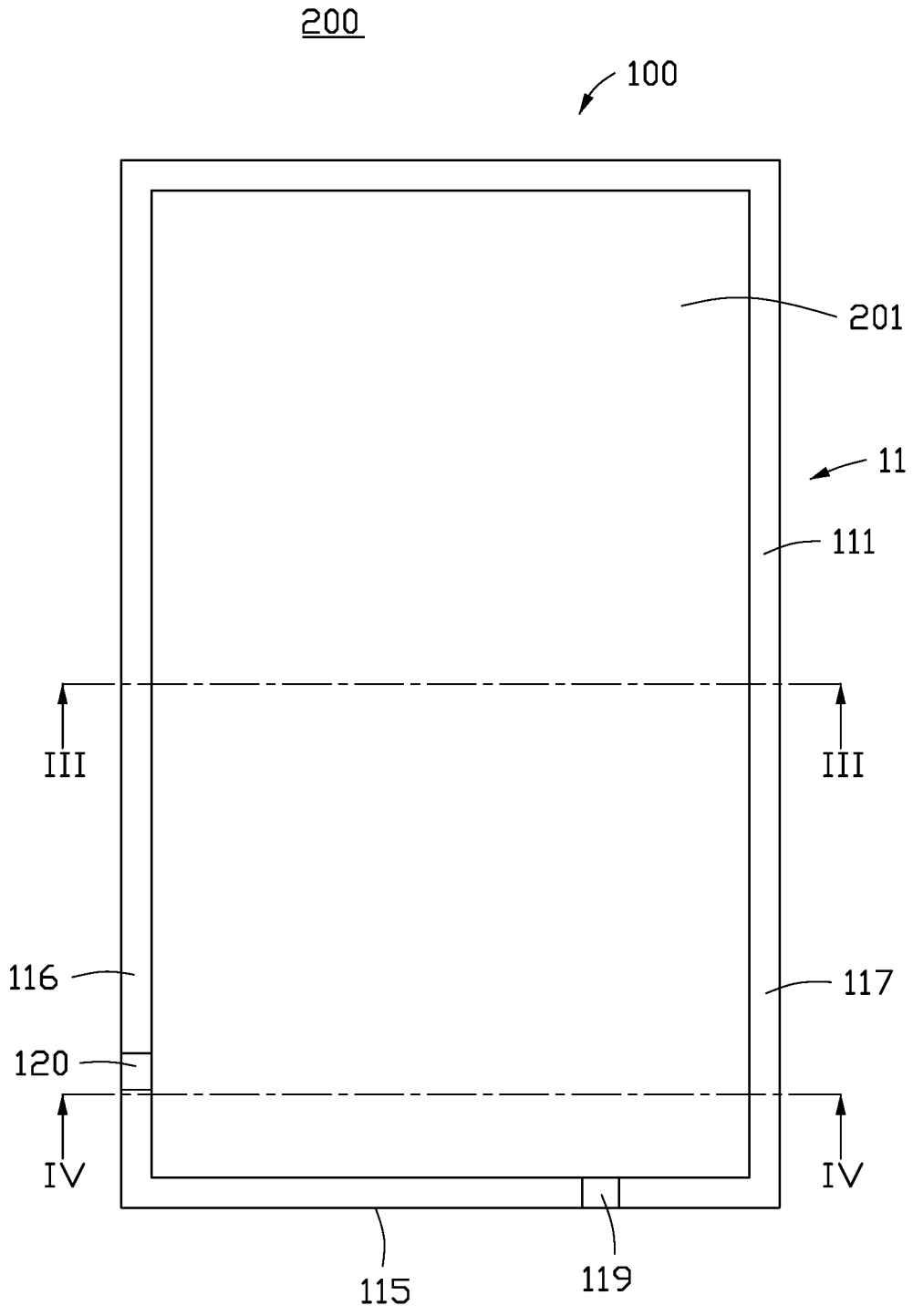
FIG. 1 is a schematic diagram of a first embodiment of a wireless communication device including an antenna structure.

It will be appreciated that for simplicity and clarity of illustration, where appropriate, reference numerals have been repeated among the different figures to indicate corresponding or analogous components. Additionally, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising" means "including, but not necessarily limited to"; it specifically indicates open-ended inclusion or membership in a so-described combination, group, series, and the like.

Embodiment 1

FIGS. 1-4 illustrate an antenna structure 100 in accordance with an embodiment of the present disclosure.

Figure 2:
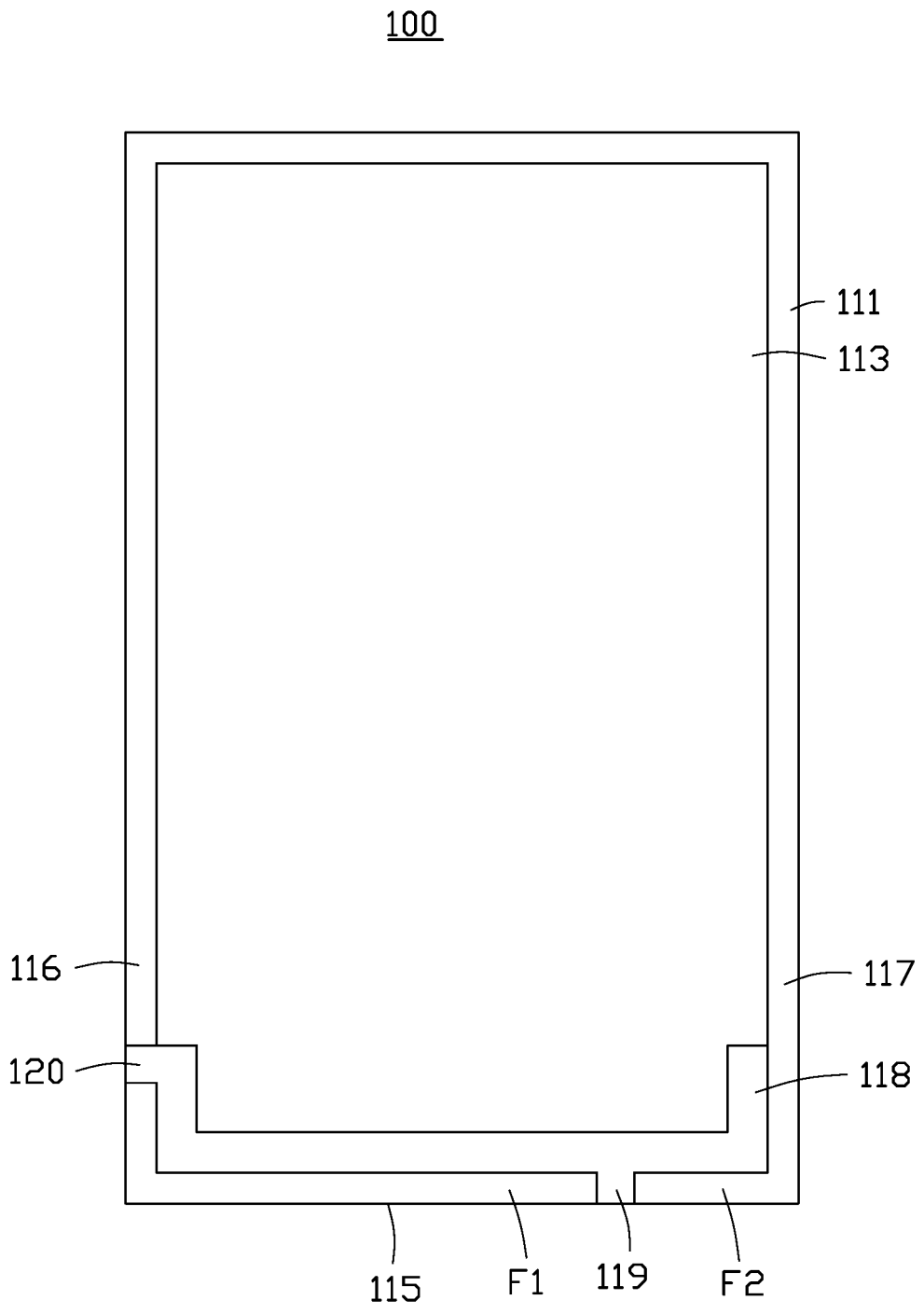
FIG. 2 is an internal schematic diagram of the wireless communication device of FIG. 1.
Figure 3:
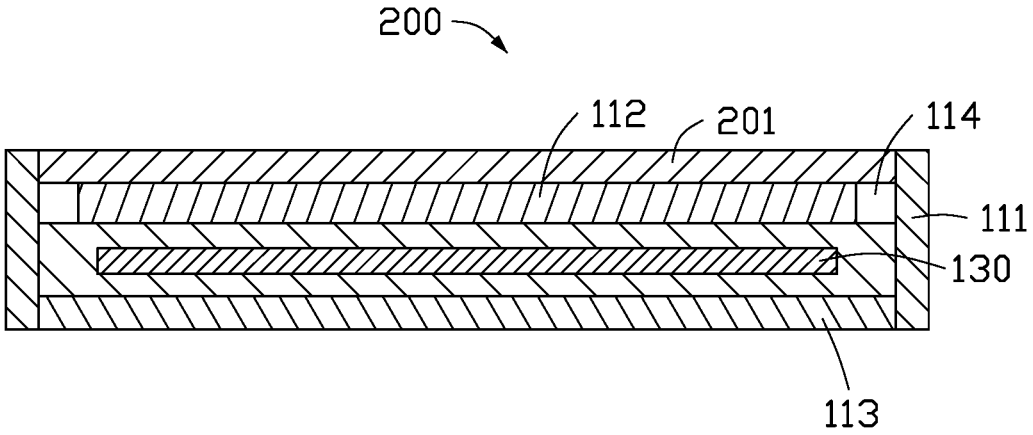
FIG. 3 is a schematic cross-sectional view taken along line III-III of FIG. 1.
Figure 4:
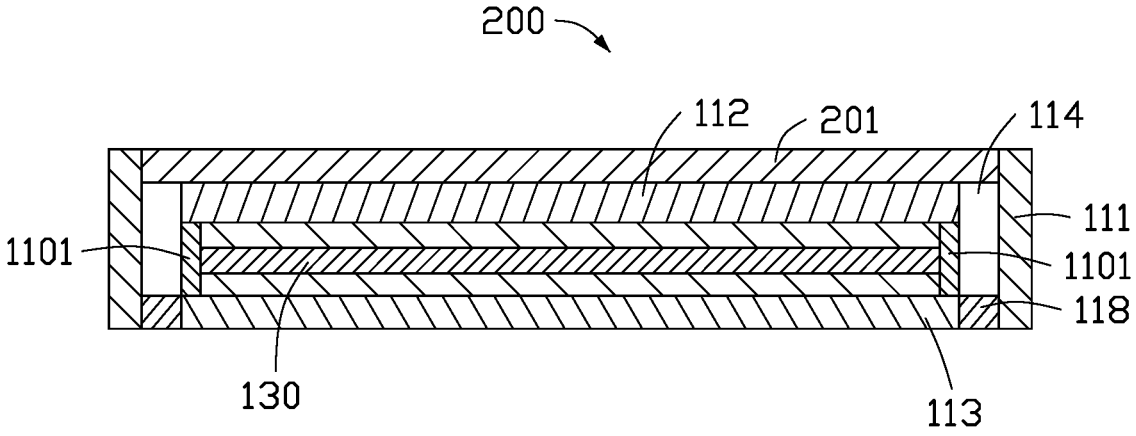
FIG. 4 is a schematic cross-sectional view taken along line IV-IV of FIG. 1.

The antenna structure 100 can be applied to a wireless communication device 200, the wireless communication device 200 can be a mobile phone and a personal digital assistant. The antenna structure 100 is used to transmit and receive radio waves, to transmit and exchange wireless signals. FIG. 1 is a schematic diagram of the antenna structure 100 applied to the wireless communication device 200. FIG. 2 is an internal schematic diagram of the wireless communication device 200. FIG. 3 is a schematic cross-sectional view taken along line III-III in the wireless communication device 200 shown in FIG. 1. FIG. 4 is a schematic cross-sectional view taken along line IV-IV in the wireless communication device 200 shown in FIG. 1.

Figure 5:
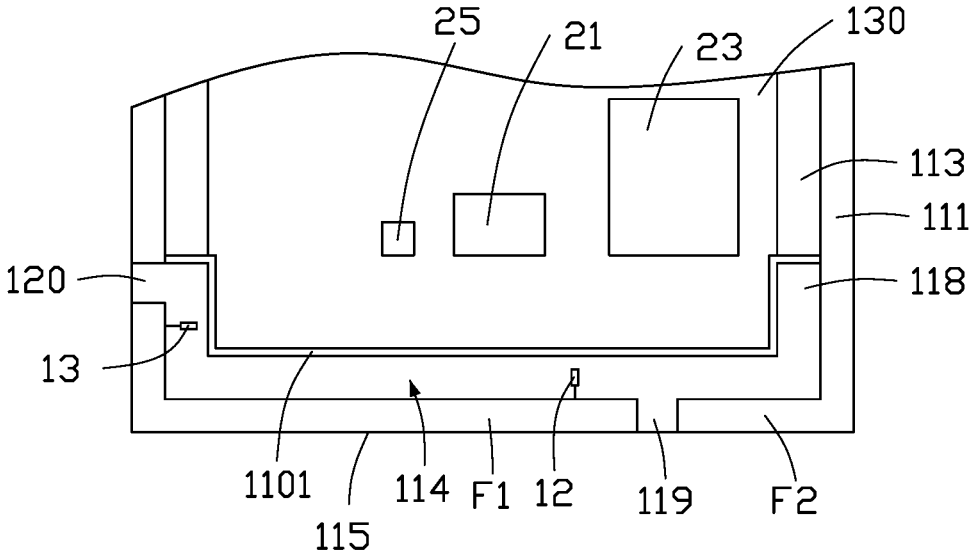
FIG. 5 is an internal schematic diagram of an antenna structure of FIG. 1.

The antenna structure 100 includes a housing 11, a first feed portion 12 (shown in FIG. 5), and a switch circuit 13 (shown in FIG. 5).

The housing 11 includes at least a system ground plane 110 (shown in FIGS. 8A-8D), a side frame 111, a middle frame 112, and a back board 113. The side frame 111, the middle frame 112, and the back board 113 form a space (shown in FIGS. 3 and 4), and the space receives a circuit board 130. The system ground plane 110 may be made of metal or other conductive materials to provide ground for the antenna structure 100.

The side frame 111 is substantially a ring structure, and made of metal or other conductive materials. The side frame 111 is disposed on the periphery of the system ground plane 110, it is disposed around the system ground plane 110.

In at least one embodiment, an edge of one side of the side frame 111 is spaced from the system ground plane 110, and a headroom 114 (shown in FIGS. 3 and 4) is formed between the side frame 111 and the system ground plane 110.

In the embodiment, a distance between the side frame 111 and the system ground plane 110 can be adjusted according to requirements. For example, the distance between the side frame 111 and the system ground plane 110 at different positions may be one distance or different distances.

The middle frame 112 is substantially a rectangular sheet, and made of metal or other conductive materials. A shape and size of the middle frame 112 are slightly less than those of the system ground plane 110. The middle frame 112 is stacked on the system ground plane 110.

In the embodiment, an opening (not shown) is provided on a side of the side frame 111 near the middle frame 112 for receiving a display unit 201 of the wireless communication device 200. The display unit 201 has a display plane, and the display plane is exposed through the opening.

The back board 113 is made of metal or other conductive materials. The back board 113 is disposed on an edge of the side frame 111. The back board 113 is disposed on a side of the system ground plane 110 facing away from the middle frame 112, and in parallel with the display plane of the display unit 201 and the middle frame 112.

In the embodiment, the system ground plane 110, the side frame 111, the middle frame 112, and the back board 113 form an integrally formed metal frame. The middle frame 112 is a metal sheet located between the display unit 201 and the system ground plane 110. The middle frame 112 is used to support the display unit 201, provide electromagnetic shielding, and improve the mechanical strength of the wireless communication device 200.

In the embodiment, the side frame 111 includes at least an end portion 115, a first side portion 116, and a second side portion 117. The end portion 115 is a bottom end of the wireless communication device 200, and the antenna structure 100 constitutes a lower antenna of the wireless communication device 200. The first side portion 116 and the second side portion 117 are disposed opposite to each other, and the first side portion 116 and the second side portion 117 are each disposed at one end of the end portion 115, and preferably disposed vertically.

The housing 11 defines a slot 118 and at least one gap. The slot 118 is defined on the back board 113. The slot 118 is substantially U-shaped, and formed on a side of the back board 113 near the end portion 115 and extends in a direction of the first side portion 116 and the second side portion 117.

In the embodiment, the housing 11 defines two gaps, namely a first gap 119 and a second gap 120, the first gap 119 and the second gap 120 are defined on the side frame 111. The first gap 119 is formed on the end portion 115 and disposed near the second side portion 117. The second gap 120 is spaced from the first gap 119. The second gap 120 is disposed on the first side portion 116 near the end portion 115. The first gap 119 and the second gap 120 both penetrate and block the side frame 111, and communicate with the slot 118.

The slot 118 and the at least one gap jointly define at least two portions radiating from the housing 11. In the embodiment, the slot 118, the first gap 119, and the second gap 120 collectively divide two radiation portions from the housing 11, namely a first radiation portion F1 and a second radiation portion F2.

The side frame 111 between the first gap 119 and the second gap 120 forms the first radiation portion F1. The side frame 111 between the first gap 119 and the slot 118 and located between the endpoints of the second side portion 117 forms the second radiation portion F2.

The first radiation portion F1 is spaced from the middle frame 112 and insulated. A side of the second radiation portion F2 near an end of the slot 118 at the second side portion 117 is connected to the system ground plane 110 and the back board 113. In the embodiment, the slot 118 separates the wave radiator of the frame (that is, the first radiation portion F1 and the second radiation portion F2) and the back board 113. The slot 118 may also separate the frame radiator and the system ground plane 110, and in a portion other than the slot 118, the side frame 111, the back board 113, and the system ground plane 110 are connected.

In the embodiment, the first gap 119 and the second gap 120 have the same width. A width of the slot 118 is less than or equal to twice the width of the first gap 119 or the second gap 120. The width of the slot 118 is 0.5-2 mm. The width of each of the first gap 119 and the second gap 120 is 1-2 mm.

In the embodiment, the slot 118, the first gap 119, and the second gap 120 are all filled with an insulating material (such as plastic, rubber, glass, wood, ceramic, etc., but is not limited to this).

Referring to FIG. 5, the wireless communication device 200 further includes at least one electronic component. In the embodiment, the wireless communication device 200 includes at least three electronic components, namely a first electronic component 21, a second electronic component 23, and a third electronic component 25.

The first electronic component 21 is a universal serial bus (USB) interface module. The first electronic component 21 is disposed on an edge of the middle frame 112 adjacent to the first radiation portion F1, and spaced apart from the first radiation portion F1 through the slot 118. The second electronic component 23 is a speaker. The second electronic component 23 is disposed on a side of the middle frame 112 adjacent to the first radiation portion F1 to be corresponding to the first gap 119.

In the embodiment, a distance between the second electronic component 23 and the slot 118 is approximately 2-10 mm. The third electronic component 25 is a microphone, which is disposed on the edge of the middle frame 112 adjacent to the first radiation portion F1. The third electronic component 25 is disposed on a side of the first electronic component 21 away from the second electronic component 23. In the embodiment, the second electronic component 23 and the third electronic component 25 are also insulated from the first radiation portion F1 through the slot 118.

In other embodiment, the positions of the second electronic component 23 and the third electronic component 25 can be adjusted according to specific requirements, for example, the two are interchangeable.

Referring to FIGS. 4 and 5, the system ground plane 110 is generally box-shaped, and the system ground plane 110 has a certain thickness. A substantially U-shaped side wall 1101 is disposed on a side of the system ground plane 110 adjacent to the slot 118. The side wall 1101 is made of a metal material.

The side wall 1101 and a portion of the side frame 111 forming the first radiation portion F1 and the second radiation portion F2 are arranged in parallel. Therefore, the side wall 1101 of the system ground plane 110 can realize a large-area coupling with the side frame 111, thereby forming a slot antenna to excite the slot antenna mode.

The side wall 1101 is disposed between the middle frame 112 and the back board 113, and two ends of the circuit board 130 resist the side wall 1101, and are located on the back board 113 adjacent to the slot 118.

In one embodiment, the circuit board 130 is seamlessly connected to the side wall 1101. In another embodiment, there is a gap between the circuit board 130 and the side wall 1101.

The middle frame 112, the side wall 1101, the back board 113, the non-radiation portion of the side frame 111, and the ground plane of the circuit board 130 are all connected to form the system ground plane 110. Furthermore, a coupling distance between the side wall 1101 of the system ground plane 110 and the side frame 111 can be adjusted according to the required impedance matching, to achieve the maximum bandwidth and maximum efficiency. In the embodiment, the coupling distance is less than or equal to twice the width of the first gap 119 or the second gap 120.

In the embodiment, the impedance matching refers to impedance matching between a signal feeding point (not shown) on the system ground plane 110 and an antenna terminal (that is, the frame radiator, such as the first radiation portion F1 and the second radiation portion F2).

In the embodiment, when the system ground plane 110 is box-shaped, the at least one electronic component can be fully inserted into the system ground plane 110, and the at least one electronic component can then be regarded as the system ground plane 110, that is, a large area of metal which is grounded.

When the at least one electronic component is completely placed in the system ground plane 110, the system ground plane 110 also needs to reserve corresponding openings and connectors, so that the at least one electronic component needing to be in contact with external component part can be exposed from inside the system ground plane 110.

In other embodiment, the system ground plane 110 is not limited to the box-shaped described above, but may also have other shapes. It is only necessary to ensure that the system ground plane 110 has the U-shaped side wall 1101 disposed in parallel with the side frame 111.

In the embodiment, the display unit 201 has a high screen-to-body ratio. That is, an area of the display plane of the display unit 201 is greater than 70% of a front area of the wireless communication device 200, and even a front full screen can be achieved.

In the embodiment, the full screen refers to a slot other than the necessary slot (such as slot 118) opened in the antenna structure 100, the left, the right, and the lower sides of the display unit 201 can be connected to the side frame 111 seamlessly.

In the embodiment, the first feed portion 12 is disposed in the headroom 114 between the system ground plane 110 and the side frame 111. One end of the first feed portion 12 may be electrically connected to a signal feed point (not shown) on the system ground plane 110 by means of an elastic sheet, a microstrip line, a strip line, a coaxial cable, and the other end of the first feed portion 12 is electrically connected to a side of the first radiation portion F1 near the first gap 119 through a match circuit (not shown), to feed currents and signals to the first radiation portion F1 and the second radiation portion F2.

In the embodiment, the first feed portion 12 may be made of iron, metal copper foil, or a conductor in a laser direct structuring (LDS) process.

Figure 6:
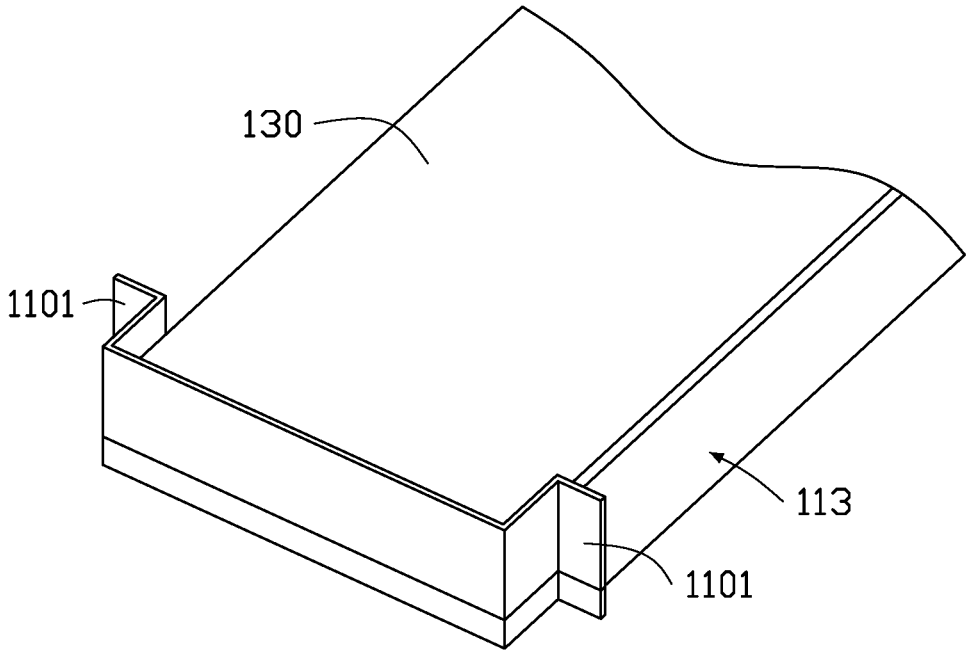
FIG. 6 is a partial perspective view of the wireless communication device of FIG. 1.

Referring to FIG. 6, the end portion 115 is parallel to the side wall 1101, the side wall 1101 obtains a current by coupling from the radiation portions F1, F2, and F3 of the side frame 111 reflecting radiation signals of the radiation portions F1, F2, and F3, to shield the circuit inside of the wireless communication device 200, such as the circuits on the circuit board 130.

Figure 7:
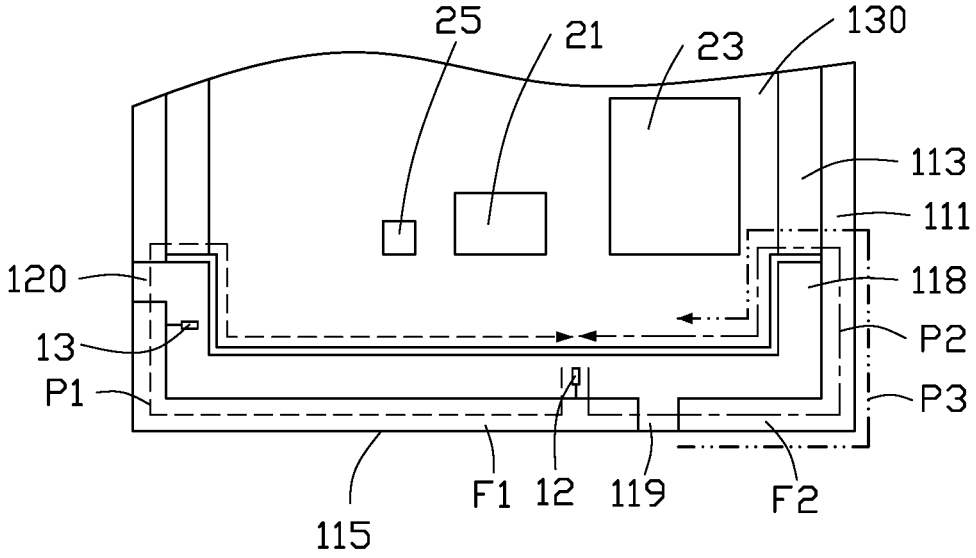
FIG. 7 is a schematic diagram of current flows during the operation of the antenna structure of FIG. 5.

FIG. 7 illustrates a diagram of current paths of the antenna structure 100. When the first feed portion 12 feeds a current, the current flows through the first radiation portion F1 toward to the second gap 120, and toward to the system ground plane 110 and the middle frame 112 (path P1). Therefore, the first radiation portion F1 constitutes a monopole antenna, to excite a first working mode, and generates a radiation signal in a first radiation frequency band.

When the first feed portion 12 feeds a current, the current will flow through the first radiation portion F1 toward to the first gap and the second radiation portion F2, toward to the system ground plane 110 and the middle frame 112, namely ground (path P2). Therefore, the second radiation portion F2 forms a loop antenna to excite a second working mode, and generates a radiation signal in a second radiation frequency band.

When the first feed portion 12 feeds a current, the current flows through the second radiation portion F2 toward to the system ground plane 110 and the middle frame 112, namely ground (path P3), and a third working mode is excited to generate a radiation signal in a third radiation frequency band.

In the embodiment, the first working mode is a Long Term Evolution Advanced (LTE-A) low frequency mode, and the second working mode is an LTE-A intermediate frequency mode. The third working mode is an LTE-A high-frequency mode. The frequency of the first radiation frequency band is 700-960 MHz. The frequency of the second radiation frequency band is 1710-2170 MHz. The frequency of the third radiation frequency band is 2300-2690 MHz.

In the embodiment, the side frame 111 and the system ground plane 110 are also electrically connected through connection methods such as springs, solder, and probes. The position of an electrical connection point between the side frame 111 and the system ground plane 110 can be adjusted according to the frequency required. For example, if the electrical connection point between the side frame 111 and the system ground plane 110 is close to the first feed portion 12, the frequency of the antenna structure 100 is shifted toward a high frequency. When the electrical connection point between the side frame 111 and the system ground plane 110 is kept away from the first feed portion 12, the frequency of the antenna structure 100 is shifted to a low frequency.

In the embodiment, a first end of the switch circuit 13 is electrically connected to a side of the first radiation portion F1 near the second gap 120, and a second end of the switch circuit 13 is electrically connected to the system ground plane 110, namely grounded.

The switch circuit 13 is configured to switch the first radiation portion F1 to the system ground plane 110, so that the first radiation portion F1 is not grounded, or switch the first radiation portion F1 to a different ground position (equivalent to switching to a different impedance component), thereby effectively adjusting the bandwidth of the antenna structure 100 to achieve multi-frequency functions.

In the embodiment, the specific structure of the switch circuit 13 may take various forms, for example, it may include a single switch, a multiple switch, a single switch with a matching component, or a multiple switch with a matching component.

Figure 8A:
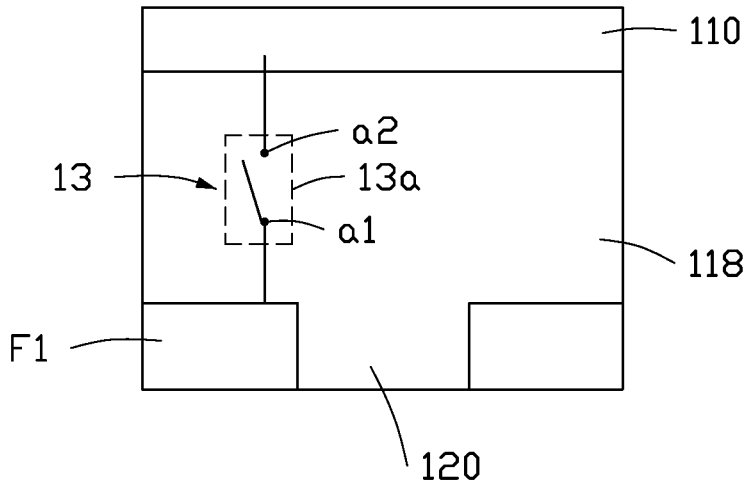
FIGS. 8A, 8B, 8C, and 8D are circuit diagrams of a switch circuit in the antenna structure of FIG. 5.

Referring to FIG. 8A, the switch circuit 13 includes a single switch 13*a*. The single switch 13*a* includes a movable contact a1 and a static contact a2. The movable contact a1 is electrically connected to the first radiation portion F1. The static contact a2 of the single switch 13*a* is electrically connected to the system ground plane 110. Therefore, by controlling the single switch 13*a* to be turned on or off, the first radiation portion F1 is electrically connected or disconnected from the system ground plane 110, and the first radiation portion F1 is controlled to be grounded or not, to achieve the functions of multi-frequency.

Figure 8B:
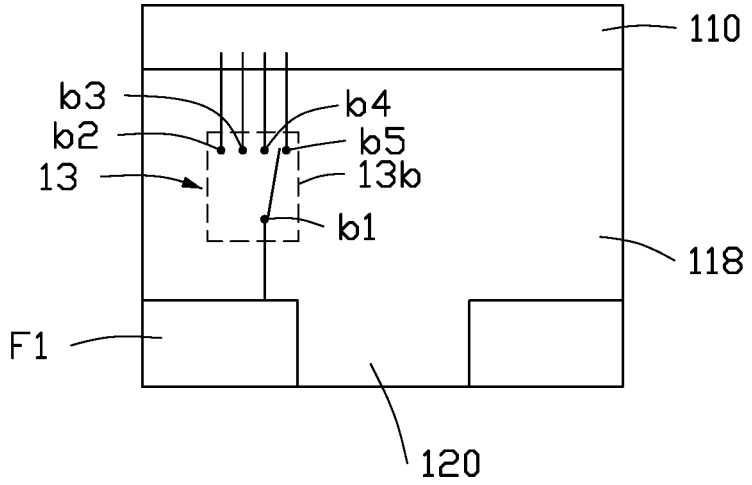

Referring to FIG. 8B, the switch circuit 13 includes a multiplexer switch 13*b*. In the embodiment, the multiplexer switch 13*b* is a four-way switch. The multiplexer switch 13*b* includes a movable contact b1, a first static contact b2, a second static contact b3, a third static contact b4, and a fourth static contact b5. The movable contact b1 is electrically connected to the first radiation portion F1. The first static contact b2, the second static contact b3, the third static contact b4, and the fourth static contact b5 are electrically connected to different positions of the system ground plane 110, respectively.

By controlling the switching of the movable contact b1, the movable contact b1 can be switched to the first static contact b2, the second static contact b3, the third static contact b4, or the fourth static contact b5, respectively. Therefore, the first radiation portion F1 may be electrically connected to different positions of the system ground plane 110, thereby achieving the functions of multi-frequency.

Figure 8C:
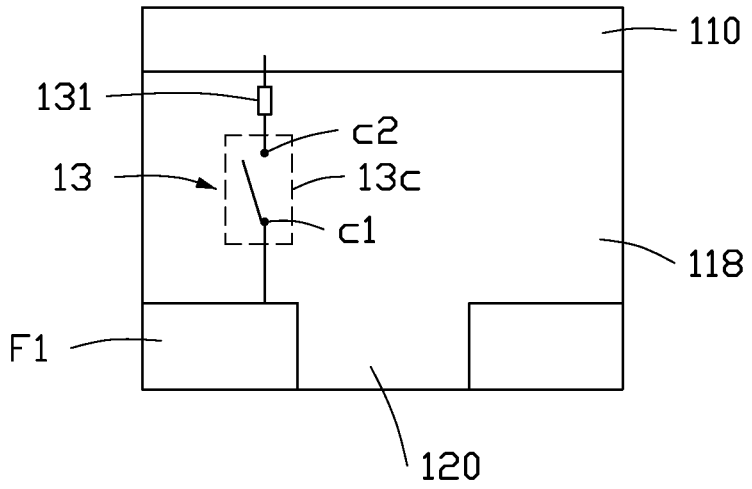

Referring to FIG. 8C, the switch circuit 13 includes a single switch 13*c* and an impedance-matching component 131. The single switch 13*c* includes a movable contact c1 and a static contact c2. The movable contact c1 is electrically connected to the first radiation portion F1. The static contact c2 is electrically connected to the system ground plane 110 through the impedance-matching component 131. The impedance-matching component 131 has a preset impedance. The impedance-matching component 131 may include an inductor, a capacitor, or a combination of an inductor and a capacitor.

Figure 8D:
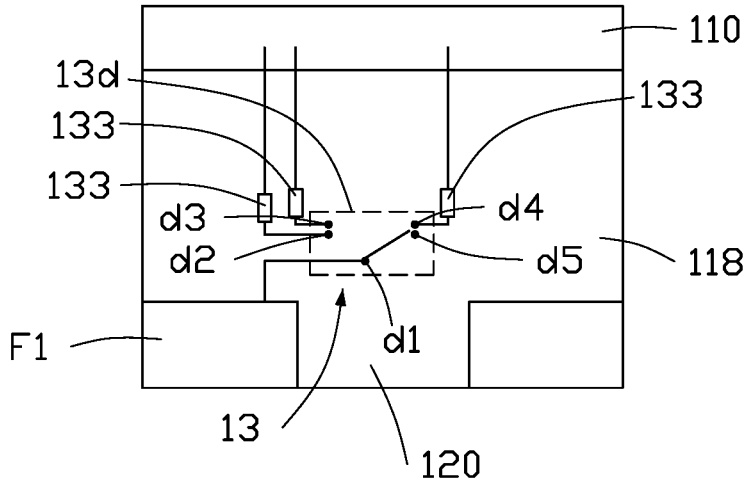

Referring to FIG. 8D, the switch circuit 13 includes a multiplexer switch 13*d* and at least one impedance-matching component 133. In the embodiment, the multiplexer switch 13*d* is a four-way switch, and the switch circuit 13 includes three impedance-matching components 133. The multiplexer switch 13*d* includes a movable contact d1, a first static contact d2, a second static contact d3, a third static contact d4, and a fourth static contact d5. The movable contact d1 is electrically connected to the first radiation portion F1. The first static contact d2, the second static contact d3, and the third static contact d4 are electrically connected to the system ground plane 110 through corresponding impedance-matching components 133, respectively. The fourth static contact d5 is suspended. Each of the three impedance-matching components 133 has a preset impedance, and the preset impedances of the three impedance-matching components 133 may be the same or different. Each of the three impedance-matching components 133 may include an inductor, a capacitor, or a combination of an inductor and a capacitor. The position where each of the three impedance-matching components 133 is electrically connected to the system ground plane 110 may be the same or different.

By controlling the switching of the movable contact d1, the movable contact d1 can be switched to the first static contact d2, the second static contact d3, the third static contact d4, or the fourth static contact d5, respectively. Therefore, the first radiation portion F1 may be electrically connected to the system ground plane 110 or disconnected from the system ground plane 110 through different impedance-matching components 133, thereby achieving the functions of multi-frequency.

In another embodiment, the switch circuit 13 is not limited to being electrically connected to the first radiation portion F1, and its position can be adjusted according to specific requirements. For example, the switch circuit 13 may be electrically connected to the second radiation portion F2.

Figure 9:
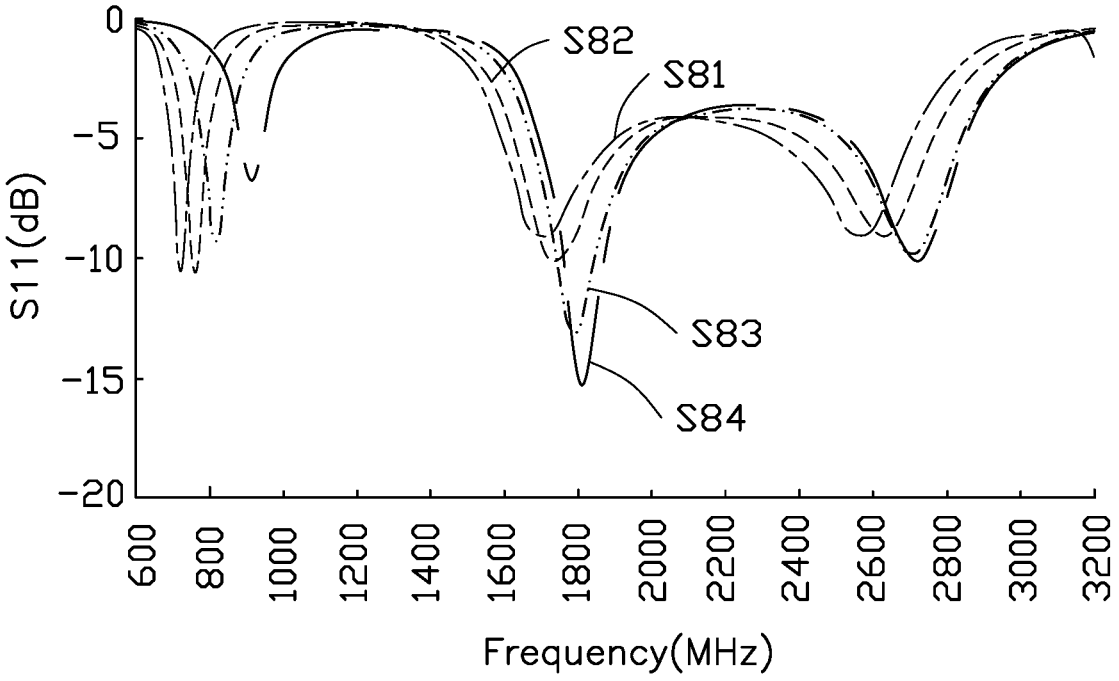
FIG. 9 is a graph of scattering parameters of the antenna structure of FIG. 1.

FIG. 9 is a graph of scattering parameters (S parameters) of the antenna structure 100. A curve S81 is the S11 value when the antenna structure 100 works in the LTE-A Band 17 frequency band (704-746 MHz), LTE-A medium and high-frequency modes. A curve S82 is the S11 value when the antenna structure 100 works in the LTE-A Band 13 frequency band (746-787 MHz), and in the LTE-A medium and high-frequency modes. A curve S83 is the S11 value when the antenna structure 100 works in the LTE-A Band 20 frequency band (791-862 MHz), and in the LTE-A medium and high-frequency modes. A curve S84 is the S11 value when the antenna structure 100 works in the LTE-A Band 8 frequency band (880-960 MHz), LTE-A medium and high-frequency modes.

Figure 10:
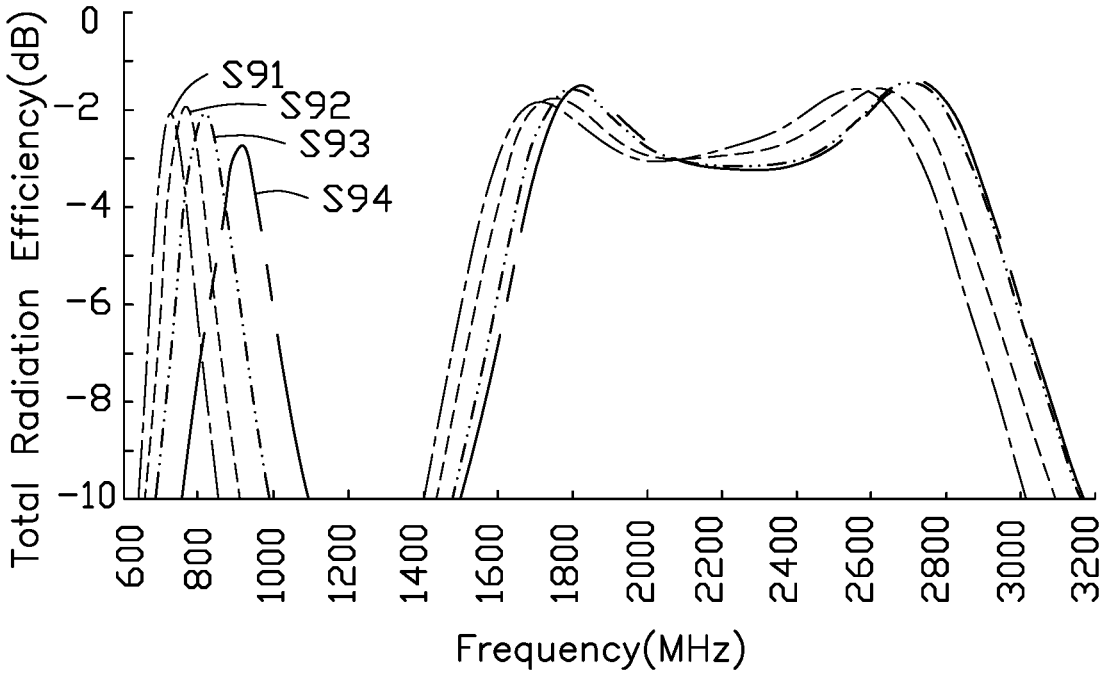
FIG. 10 is a diagram of total radiation efficiency of the antenna structure of FIG. 1.

FIG. 10 is a graph of total radiation efficiency of the antenna structure 100. A curve S91 is the total radiation efficiency of the antenna structure 100 when the antenna structure 100 works in the LTE-A Band 17 frequency band (704-746 MHz), LTE-A medium and high frequency modes. A curve S92 is the total radiation efficiency of the antenna structure 100 when the antenna structure 100 works in the LTE-A Band 13 frequency band (746-787 MHz), and in the LTE-A medium and high frequency modes. A curve S93 is the total radiation efficiency of the antenna structure 100 when the antenna structure 100 works in the LTE-A Band 20 frequency band (791-862 MHz), LTE-A medium and high frequency modes. A curve S94 is the total radiation efficiency of the antenna structure 100 when it works in the LTE-A Band 8 frequency band (880-960 MHz), LTE-A medium and high frequency modes.

As can be seen from FIG. 9 and FIG. 10, the antenna structure 100 is provided with the switch circuit 13 to switch between various low frequency modes of the antenna structure 100, which can effectively improve the low frequency bandwidth and have an optimal antenna effectiveness. Furthermore, when the antenna structure 100 works in the LTE-A Band 17 frequency band (704-746 MHz), the LTE-A Band 13 frequency band (746-787 MHz), the LTE-A Band 20 frequency band (791-862 MHz), and the LTE-A Band 8 frequency band (880-960 MHz), respectively, the LTE-A medium frequency and high frequency bands of the antenna structure 100 are both 1710-2690 MHz. When the switch circuit 13 is switched across, the switch circuit 13 is only used to change the low frequency mode of the antenna structure 100 without affecting the medium and high frequency modes. This feature is beneficial for carrier aggregation (CA) in LTE-A.

The antenna structure 100 can generate various working modes, such as low, medium, and high-frequency modes, through the switching of the switch circuit 13, and covers communication bands commonly used in the world.

For example, the antenna structure 100 can cover GSM850/900/WCDMA Band 5/Band 8/Band 13/Band 17/Band 20 at low frequencies, GSM 1800/1900/WCDMA 2100 (1710-2170 MHz) at intermediate frequencies, and LTE-A at high frequencies Band 7, Band 40, Band 41 (2300-2690 MHz). The design frequency band of the antenna structure 100 can be applied to the operation of the GSM Qual-band, UMTS Band I/II/V/VIII frequency bands and the LTE 850/900/1800/1900/2100/2300/2500 frequency bands commonly used worldwide.

The antenna structure 100 sets at least one gap (such as the first gap 119 and the second gap 120) on the side frame 111 to create at least two radiation portions from the side frame 111. The antenna structure 100 is further provided with the switch circuit 13 at the ends of different radiation portions (such as the first radiation portion F1 and the second radiation portion F2). Therefore, it can cover multiple frequency bands such as low frequency, intermediate frequency, and high frequency through different switching methods, which meets the carrier aggregation application (CA) of LTE-A, and makes the radiation of the antenna structure 100 more effective in broadband ranges compared to a general metal back. In addition, the antenna structure 100 also uses the side frame 111 and the system ground plane 110 to be spaced apart to form a slot antenna, so as to generate a large coupling area between the side frame 111 and the system ground plane 110, thereby achieving the maximum frequency bandwidth and the best efficiency. The antenna structure 100 has a front full screen, and the antenna structure 100 still has a good performance in the unfavorable environment of the back board 113, the side frame 111, and a large area of grounded metal around it.

Embodiment 2

Figure 11:
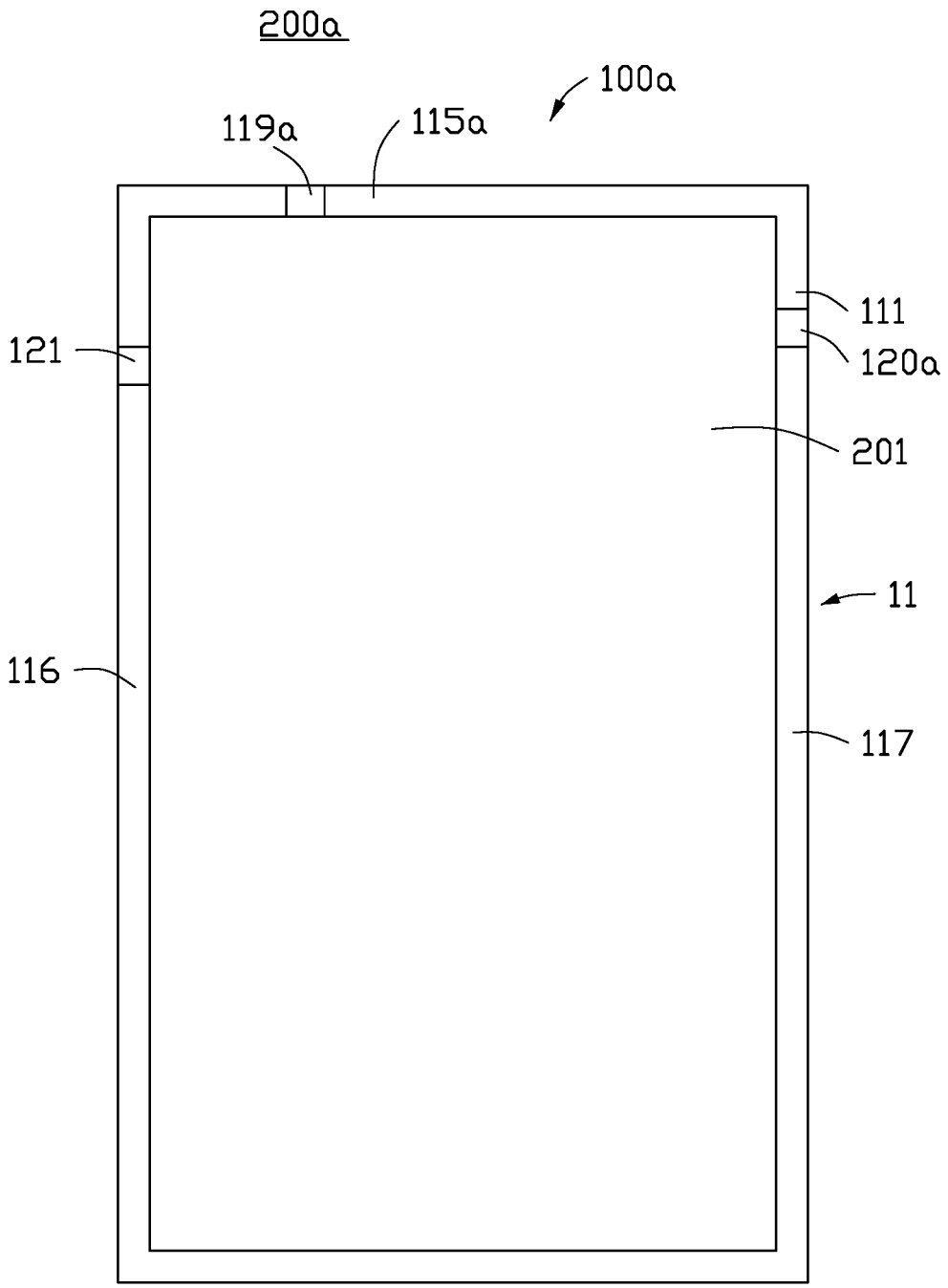
FIG. 11 is a schematic diagram of a second embodiment of a wireless communication device.
Figure 12:
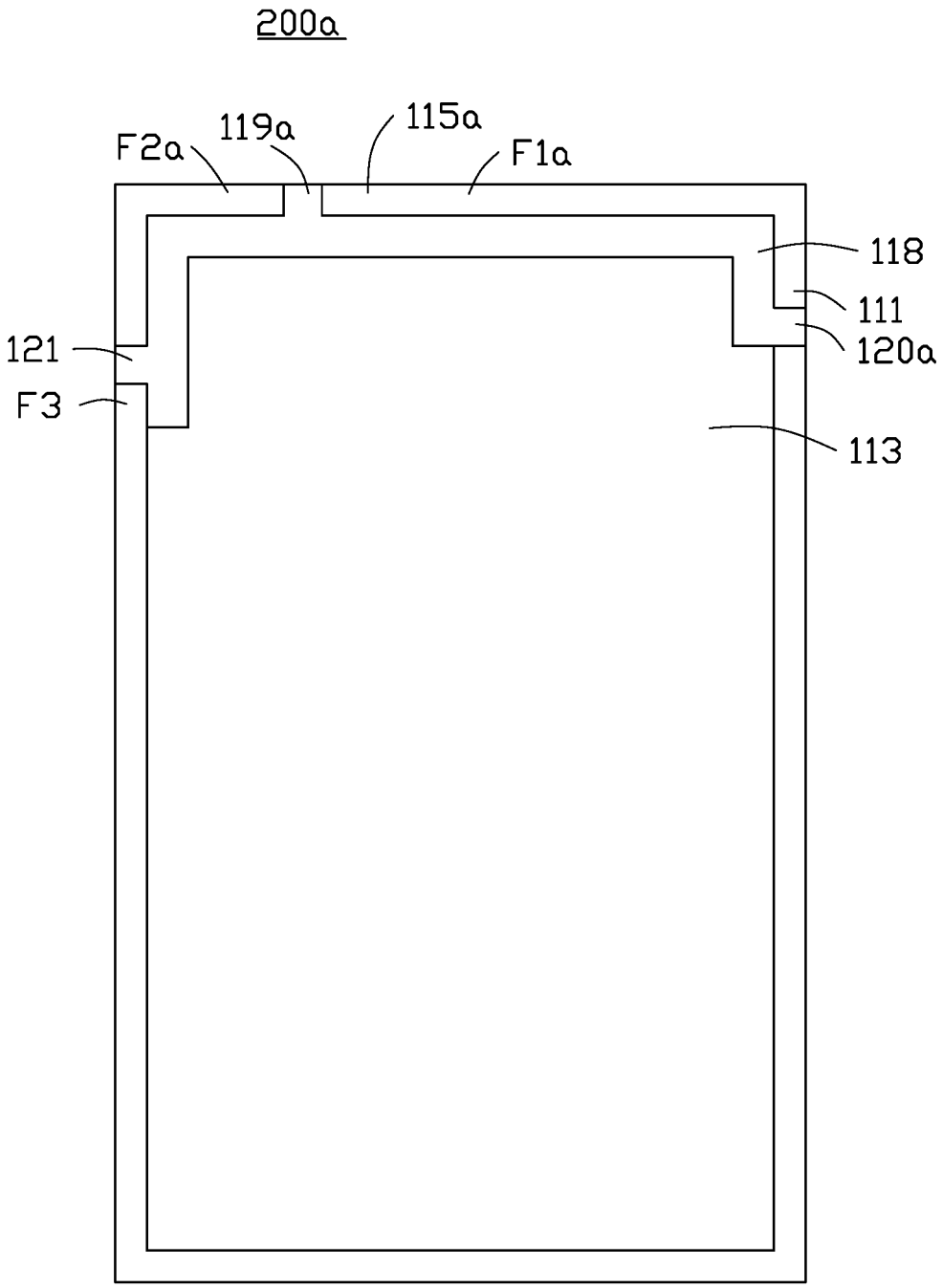
FIG. 12 is an internal schematic diagram of the wireless communication device of FIG. 11.
Figure 13:
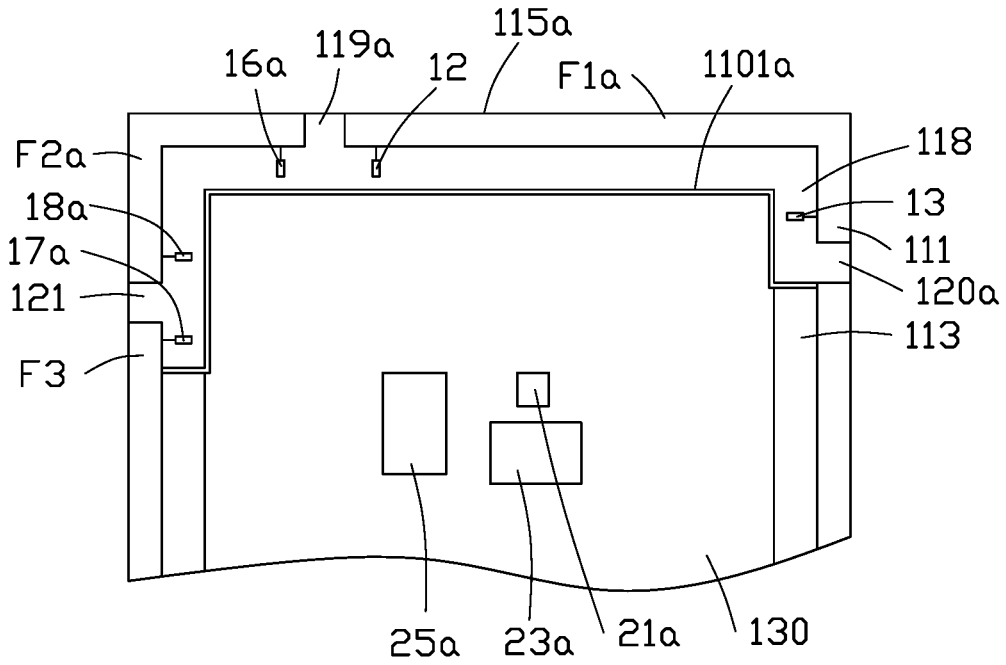
FIG. 13 is an internal schematic diagram of an antenna structure of FIG. 11.

FIGS. 11-13 illustrate an antenna structure 100*a* in accordance with a second embodiment of the present disclosure.

The antenna structure 100*a* can be applied to a wireless communication device 200*a*, the wireless communication device 200*a* can be a mobile phone and a personal digital assistant. The antenna structure 100*a* is used to transmit and receive radio waves, to transmit and exchange wireless signals. FIG. 11 is a schematic diagram of the antenna structure 100*a* applied to the wireless communication device 200*a*. FIG. 12 is an internal schematic diagram of the wireless communication device 200*a*. FIG. 13 is an internal schematic diagram of the antenna structure 100*a*.

The antenna structure 100*a* includes a housing 11, a first feed portion 12, and a switch circuit 13.

The housing 11 includes at least a system ground plane 110, a side frame 111, a middle frame 112, and a back board 113. The side frame 111 includes an end portion 115*a*, a first side portion 116, and a second side portion 117. In the embodiment, the housing 11 defines a slot 118 and at least one gap. The wireless communication device 200*a* includes a first electronic component 21*a*, a second electronic component 23*a*, and a third electronic component 25*a*.

In the embodiment, the antenna structure 100*a* is different from the antenna structure 100 in Embodiment 1 in that the end portion 115*a* is not a bottom end of the wireless communication device 200*a*, but a top end of the wireless communication device 200*a*. That is, the antenna structure 100*a* constitutes an upper antenna of the wireless communication device 200*a* instead of being a lower antenna.

In the embodiment, the antenna structure 100*a* is different from the antenna structure 100 in embodiment 1 in that the number of gaps on the housing 11 is three. That is, in addition to a first gap 119*a* and a second gap 120*a*, a third gap 121 is also provided on the housing 11. The first gap 119*a* is disposed on the end portion 115*a* near the first side portion 116. The second gap 120*a* is disposed on the second side portion 117 near the end portion 115*a*. The third gap 121 is disposed on the first side portion 116 near the end portion 115*a*. The first gap 119*a*, the second gap 120*a*, and the third gap 121 penetrate and block the side frame 111, and communicate with the slot 118. In the embodiment, the slot 118, the first gap 119*a*, the second gap 120*a*, and the third gap 121 define the housing 11 into three radiation portions, namely, a first radiation portion F1*a*, a second radiation portion F2*a*, and a third radiation portion F3.

The side frame 111 between the first gap 119*a* and the second gap 120*a* forms the first radiation portion F1*a*, the side frame 111 between the first gap 119*a* and the third gap 121 forms the second radiation portion F2*a*, and the side frame 111 between the third gap 121 and the slot 118 located at an end of the first side portion 116 forms the third radiation portion F3.

In the embodiment, the types and positions of the first electronic component 21*a*, the second electronic component 23*a*, and the third electronic component 25*a* are different from the types and positions of the first electronic component 21, the second electronic component 23, and the third electronic component 25 of the antenna structure 100 in Embodiment 1. The first electronic component 21*a* is a proximity sensor. The first electronic component 21*a* is disposed on an edge of a circuit board 130 adjacent to the first radiation portion F1*a*. The second electronic component 23*a* is a front lens module. The second electronic component 23*a* is disposed on the circuit board 130 on the side of the first electronic component 21*a* facing away from the first radiation portion F1*a*. The third electronic component 25*a* is a receiver. The third electronic component 25*a* is disposed on an edge of the circuit board 130 adjacent to the first radiation portion F1*a*. The third electronic component 25*a* is disposed between the first electronic component 21*a* and the first gap 119*a*.

In the embodiment, the first electronic component 21*a*, the second electronic component 23*a*, and the third electronic component 25*a* are all insulated from the first radiation portion F1*a* through the slot 118. A distance between the first electronic component 21*a* and the slot 118 is 2-10 mm. A distance between the third electronic component 25*a* and the slot 118 is 2-10 mm.

In the embodiment, one end of the first feed portion 12 may be electrically connected to a signal feed point (not shown) on the system ground plane 110 through a spring, a microstrip line, a strip line, and a coaxial cable, and the other end of the first feed portion 12 passing through a match circuit (not shown) is electrically connected to a side of the first radiation portion F1*a* near the first gap 119*a*, and is configured to feed currents and signals to the first radiation portion F1*a*.

In the embodiment, the antenna structure 100*a* is different from the antenna structure 100 in embodiment 1 in that the antenna structure 100*a* further includes a second feed portion 16*a*, a third feed portion 17*a*, and a ground portion 18*a*.

One end of the second feed portion 16*a* may be electrically connected to a signal feed point (not shown) on the system ground plane 110 by means of an elastic sheet, a microstrip line, a strip line, a coaxial cable, and the other end of the second feed portion 16*a* connected through a match circuit (not shown) is electrically connected to a side of the second radiation portion F2*a* near the first gap 119*a* for feeding currents and signals to the second radiation portion F2*a*.

One end of the third feed portion 17*a* may be electrically connected to a signal feed point (not shown) on the system ground plane 110 by means of an elastic sheet, a microstrip line, a strip line, a coaxial cable, and the other end of the third feed portion 17*a* connected through a match circuit (not shown) is electrically connected to a side of the third radiation portion F3 near the third gap 121 for feeding currents and signals to the third radiation portion F3.

One end of the ground portion 18*a* is electrically connected to a side of the second radiation portion F2*a* near the third gap 121, and other end of the ground portion 18*a* may be electrically connected to the system ground plane 110, by the second radiation portion F2*a*.

In the embodiment, one end of the switch circuit 13 is electrically connected to the first radiation portion F1*a*, and other end of the switch circuit 13 is electrically connected to the system ground plane 110. In other embodiments, the switch circuit 13 is not limited to be electrically connected to the first radiation portion F1*a*, and may also be connected to other radiation portions, such as the second radiation portion F2*a* and the third radiation portion F3. The specific structure of the switch circuit 13 may be in various forms, such as any one structure of FIG. 8A to FIG. 8D.

In the embodiment, the first radiation portion F1*a* is close to the second gap 120*a* through the switch circuit 13, and the second radiation portion F2*a* is close to the third gap 121 through the ground portion 18*a*. The third radiation portion F3 is electrically connected to the system ground plane 110 and the back board 113 near an end of the slot 118 and located at an end of the first side portion 116. In the embodiment, the three radiation portions, namely the first radiation portion F1*a*, the second radiation portion F2*a*, and the third radiation portion F3, are provided with corresponding feed portions and ground points.

In the embodiment, a substantially U-shaped side wall 1101*a* is defined on a side of the system ground plane 110 adjacent to the slot 118. The side wall 1101*a* is made of a metal material. The side wall 1101*a* and the side frame 111 form a portion where the first radiation portion F1*a*, the second radiation portion F2*a*, and the third radiation portion F3 are arranged in parallel. The U-shaped side wall 1101*a* of the system ground plane 110 realizes large-area coupling with the side frame 111, thereby forming a slot antenna to excite the mode of the slot antenna. The coupling distance between the U-shaped side wall 1101*a* of the system ground plane 110 and the side frame 111 can be adjusted according to the required impedance matching to achieve the maximum bandwidth and maximum efficiency.

Figure 14A:
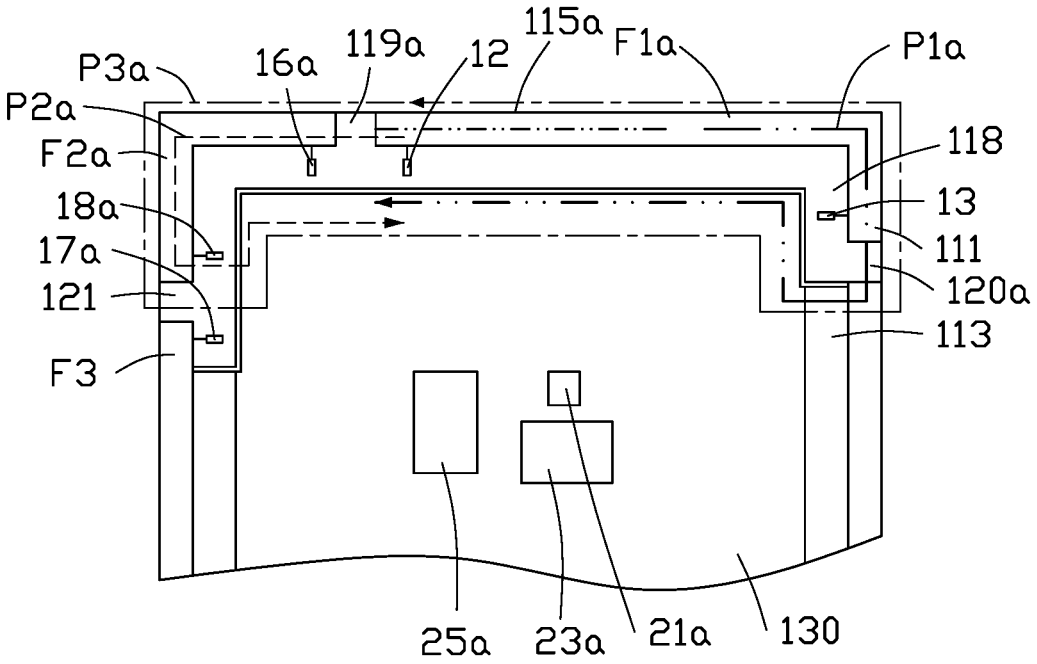
FIGS. 14A and 14B are schematic diagrams of current flows during the operation of the antenna structure of FIG. 13.

FIG. 14A is a diagram of current paths of the antenna structure 100*a* when the first feed portion 12 is feeding current. When the first feed portion 12 feeds a current, the current flows through the first radiation portion F1*a* toward to the second gap 120*a*, and toward to the system ground plane 110 and the middle frame 112 (path P1*a*). Therefore, the first radiation portion F1*a* constitutes a monopole antenna to excite a first working mode, and generates a radiation signal in a first radiation frequency band.

When the first feed portion 12 feeds a current, the current flows through the second radiation portion F2*a* and is grounded through the ground portion 18*a* (path P2*a*). Therefore, the second radiation portion F2*a* constitutes a loop antenna to excite a second working mode, and generates a radiating signal in a second radiation frequency band.

When the first feed portion 12 feeds a current, the current flows through the first radiation portion F1*a* and the second radiation portion F2*a* toward to the system ground plane 110 and the middle frame 112, and flows through the first radiation portion F1*a* (path P3*a*) to excite a third working mode, and generates a radiation signal in a third radiation frequency band.

In the embodiment, the first working mode includes an LTE-A low-frequency mode, an ultra-IF mode, and an LTE-A intermediate-frequency mode. The second working mode is an LTE-A high-frequency mode. The third working mode is a UHF mode. The frequencies of the first radiation frequency band include 700-960 MHz, 1447.9-1510.9 MHz, and 1710-2170 MHz. The frequency of the second radiation frequency band is 2300-2690 MHz. The frequency of the third radiation frequency band is 3400-3800 MHz.

Figure 14B:
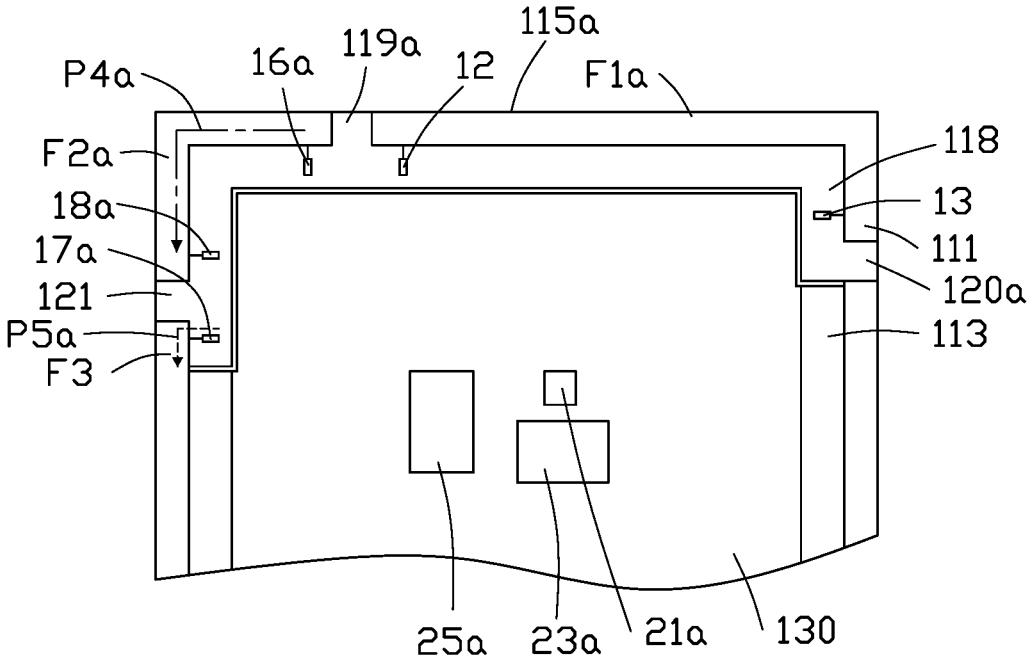

FIG. 14B shows current paths of the antenna structure 100*a* when the second feed portion 16*a* and the third feed portion 17*a* respectively feed current.

When the second feed portion 16*a* feeds a current, the current flows through the second radiation portion F2*a* (path P4*a*) to excite a fourth working mode, and generates a radiation signal in a fourth radiation frequency band.

When the third feed portion 17*a* feeds a current, the current flows through the third radiation portion F3 toward to the system ground plane 110 and the middle frame 112 (path P5*a*), and then excites a fifth working mode to generate a radiation signal in a fifth radiation frequency band.

In the embodiment, the fourth working mode includes a Global Positioning System (GPS) mode and a WIFI 2.4 GHz mode. The fifth working mode is a WIFI 5 GHz mode. The frequency of the fourth radiation frequency band includes 1575 MHz and 2400-2484 MHz. The frequency of the fifth radiation frequency band is 5150-5850 MHz.

Figure 15:
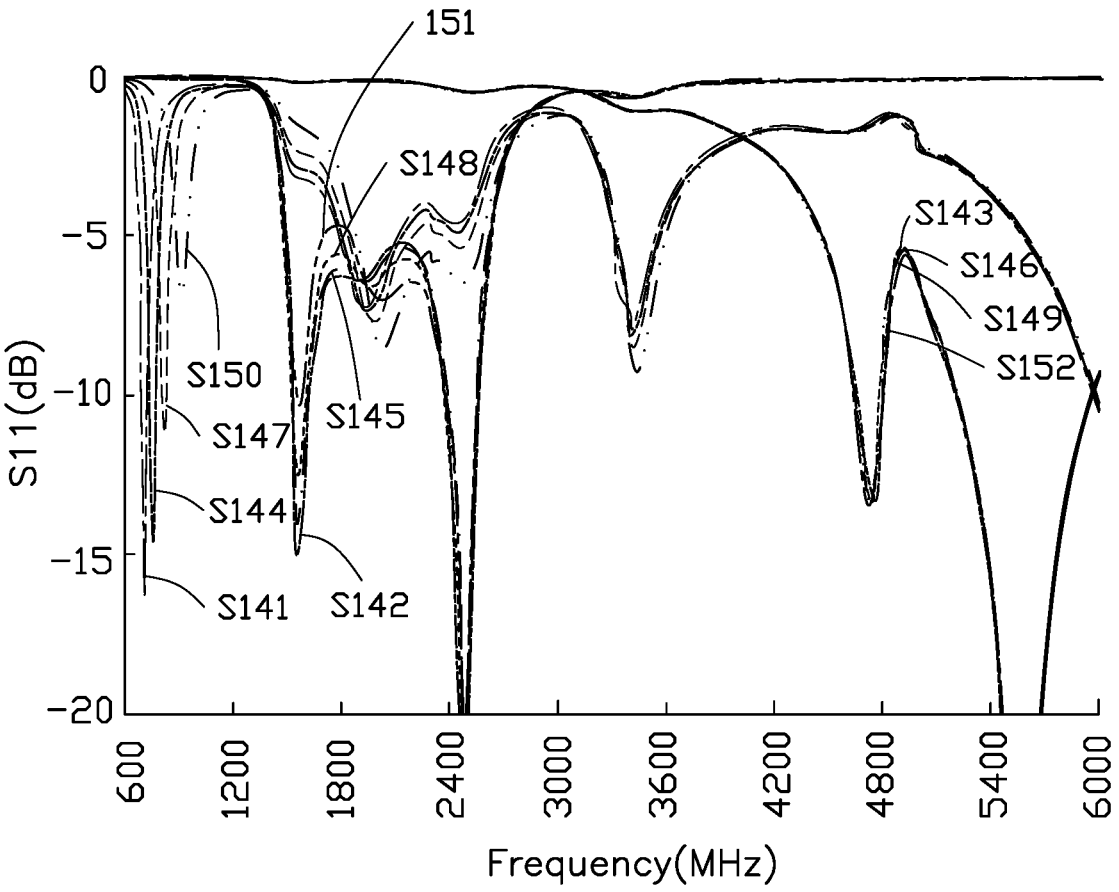
FIG. 15 is a graph of scattering parameters of the antenna structure of FIG. 11.

FIG. 15 is a graph of S parameters of the antenna structure 100*a*. A curve S141 is the S11 value when the antenna structure 100*a* works in the LTE-A Band 17 frequency band (704-746 MHz), LTE-A medium, high frequency, ultra intermediate frequency, and ultra high frequency modes. A curve S142 is the S11 value of the antenna structure 100*a* working in the LTE-A Band 17 frequency band (704-746 MHz), GPS mode, and WIFI 2.4 GHz mode. A curve S143 is the S11 value of the antenna structure 100*a* working in the LTE-A Band 17 frequency band (704-746 MHz) and the WIFI 5 GHz mode.

S144 is the S11 value when the antenna structure 100*a* works in the LTE-A Band 13 frequency band (746-787 MHz), LTE-A medium, high frequency, ultra intermediate frequency, and ultra high frequency modes. S145 is the S11 value when the antenna structure 100*a* works in the LTE-A Band 13 frequency band (746-787 MHz), GPS mode, and WIFI 2.4 GHz mode. S146 is the S11 value of the antenna structure 100*a* working in the LTE-A Band 13 frequency band (746-787 MHz) and the WIFI 5 GHz mode.

A curve S147 is the S11 value when the antenna structure 100*a* works in the LTE-A Band 20 frequency band (791-862 MHz), LTE-A medium, high frequency, ultra intermediate frequency, and ultra high frequency modes. A curve S148 is the S11 value when the antenna structure 100*a* works in the LTE-A Band 20 frequency band (791-862 MHz), GPS mode, and WIFI 2.4 GHz mode. A curve S149 is the S11 value of the antenna structure 100*a* working in the LTE-A Band 20 frequency band (791-862 MHz) and the WIFI 5 GHz mode.

A curve S150 is the S11 value when the antenna structure 100*a* works in the LTE-A Band 8 frequency band (880-960 MHz), LTE-A medium, high frequency, ultra intermediate frequency, and ultra high frequency modes. A curve S151 is the S11 value when the antenna structure 100*a* works in the LTE-A Band 8 frequency band (880-960 MHz), GPS mode, and WIFI 2.4 GHz mode. A curve S152 is the S11 value of the antenna structure 100*a* working in the LTE-A Band 8 frequency band (880-960 MHz) and the WIFI 5 GHz mode.

Figure 16:
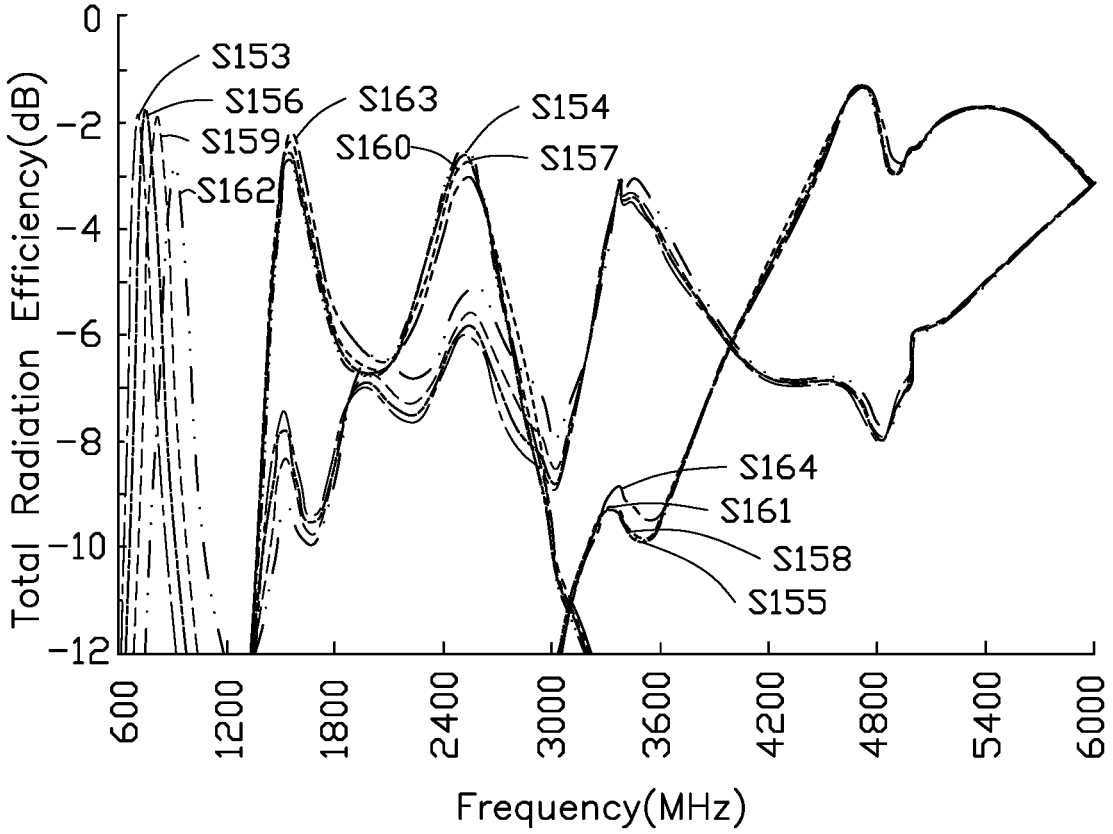
FIG. 16 is a graph of total radiation efficiency of the antenna structure of FIG. 11.

FIG. 16 is a graph of total radiation efficiency of the antenna structure 100*a*. A curve S153 is the total radiation efficiency when the antenna structure 100*a* works in the LTE-A Band 17 frequency band (704-746 MHz), LTE-A medium, high frequency, ultra intermediate frequency, and ultra high frequency modes. A curve S154 is the total radiation efficiency of the antenna structure 100*a* operating in the LTE-A Band 17 frequency band (704-746 MHz), GPS mode, and WIFI 2.4 GHz mode. A curve S155 is the total radiation efficiency of the antenna structure 100*a* working in the LTE-A Band 17 frequency band (704-746 MHz) and the WIFI 5 GHz mode.

S156 is the total radiation efficiency when the antenna structure 100*a* works in the LTE-A Band 13 frequency band (746-787 MHz), LTE-A medium, high frequency, ultra intermediate frequency, and ultra high frequency modes. S157 is the total radiation efficiency when the antenna structure 100*a* works in the LTE-A Band 13 frequency band (746-787 MHz), GPS mode, and WIFI 2.4 GHz mode. S158 is the total radiation efficiency of the antenna structure 100*a* working in the LTE-A Band 13 frequency band (746-787 MHz) and the WIFI 5 GHz mode.

A curve S159 is the total radiation efficiency when the antenna structure 100*a* works in the LTE-A Band 20 frequency band (791-862 MHz), LTE-A medium, high frequency, ultra intermediate frequency, and ultra high frequency modes. A curve S160 is the total radiation efficiency when the antenna structure 100*a* works in the LTE-A Band 20 frequency band (791-862 MHz), GPS mode, and WIFI 2.4 GHz mode. A curve S161 is the total radiation efficiency of the antenna structure 100*a* working in the LTE-A Band 20 frequency band (791-862 MHz) and the WIFI 5 GHz mode.

A curve S162 is the total radiation efficiency when the antenna structure 100*a* works in the LTE-A Band 8 frequency band (880-960 MHz), LTE-A medium, high frequency, ultra intermediate frequency, and ultra high frequency modes. A curve S163 is the total radiation efficiency when the antenna structure 100*a* works in the LTE-A Band 8 frequency band (880-960 MHz), GPS mode, and WIFI 2.4 GHz mode. A curve S164 is the total radiation efficiency of the antenna structure 100*a* working in the LTE-A Band 8 frequency band (880-960 MHz) and the WIFI 5 GHz mode.

It can be seen from FIG. 15 and FIG. 16 that the antenna structure 100*a* is provided with the switch circuit 13 to switch between various low-frequency modes of the antenna structure 100*a*, which can effectively improve the low-frequency bandwidth and have the best antenna efficiency. When the antenna structure 100*a* works in the LTE-A Band 17 frequency band (704-746 MHz), the LTE-A Band 13 frequency band (746-787 MHz), the LTE-A Band 20 frequency band (791-862 MHz), and the LTE-A Band 8 frequency band (880-960 MHz), the antenna structure 100*a* can also cover multiple frequency bands such as the corresponding intermediate frequency band, high frequency band, ultra intermediate frequency band, ultra high frequency band, GPS frequency band, WIFI 2.4 GHz frequency band and WIFI 5 GHz frequency band.

When the switch circuit 13 is switched across, the switch circuit 13 is only used to change the low-frequency mode of the antenna structure 100*a* without affecting the medium and high-frequency modes. This characteristic is beneficial to the carrier aggregation application of LTE-A (Carrier Aggregation, CA).

The antenna structure 100*a* can generate various working modes through switching of the switch circuit 13, such as low frequency mode, intermediate frequency mode, high frequency mode, ultra intermediate frequency mode, ultra high frequency mode, GPS mode, WIFI 2.4 GHz mode and WIFI 5 GHz mode, covering communication frequency bands commonly used in the world.

The antenna structure 100*a* can cover GSM850/900/WCDMA Band 5/Band 8/Band 13/Band 17/Band 20 at low frequencies, GSM 1800/1900/WCDMA 2100 (1710-2170 MHz) at intermediate frequencies, and LTE-A Band 7, Band 40, Band 41 (2300-2690 MHz), UIF covers 1447.9-1510.9 MHz, UHF covers 3400-3800 MHz, and can also cover GPS frequency band, Wi-Fi 2.4 GHz frequency band, and Wi-Fi 5 GHz frequency band. The designed frequency band of the antenna structure 100*a* can be applied to the operation of the GSM Qual-band, UMTS Band I/II/V/VIII frequency bands and the LTE 850/900/1800/1900/2100/2300/2500 frequency bands commonly used worldwide.

The antenna structure 100*a* is provided with at least one gap (such as the first gap 119*a*, the second gap 120*a*, and the third gap 121) on the side frame 111 to define at least two radiating portions from the side frame 111. The antenna structure 100*a* is further provided with the switch circuit 13 at the ends of different radiation portions (such as the first radiation portion F1*a*, the second radiation portion F2*a*, and the third radiation portion F3). In this way, different switching modes can be invoked to cover multiple frequency bands such as low frequency, intermediate frequency, high frequency, ultra intermediate frequency, ultra high frequency, GPS, Wi-Fi 2.4 GHz and Wi-Fi 5 GHz, the different radiations of the antenna structure 100*a* can be compared with broadband effect for general metal back antenna.

The antenna structure 100*a* can improve the low-frequency bandwidth and have better antenna efficiency. In addition, it can also increase the ultra-IF and UHF frequency bands, covering the requirements of global frequency band applications and supporting carrier aggregation (CA) applications. The antenna structure 100*a* also uses the side frame 111 spaced from the system ground plane 110 to form a slot antenna, so as to generate a large coupling area between the side frame 111 and the system ground plane 110, thereby achieving the maximum frequency bandwidth and the best efficiency.

The antenna structure 100*a* has a front full screen, and the antenna structure 100*a* still performs well in the unfavorable environment of the all-metal back board 113, the side frame 111, and a large amount of grounded metal around it.

The antenna structure 100 of the Embodiment 1 and the antenna structure 100*a* of the Embodiment 2 can be applied to the same wireless communication device. For example, the antenna structure 100 is set at a lower end of a wireless communication device as a main antenna, and the antenna structure 100*a* is set at an upper end of the wireless communication device as a secondary antenna. When the wireless communication device transmits a wireless signal, the wireless communication device transmits the wireless signal using the main antenna. When the wireless communication device receives a wireless signal, the wireless communication device uses the main antenna and the secondary antenna together to receive the wireless signal.

Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. An antenna structure, comprising:

a side wall;

a first feed portion; and a housing comprising a side frame, a middle frame, and a back board; wherein the middle frame and the back board are respectively connected to both sides of the side wall, and the middle frame and the back board are arranged in parallel; the middle frame is connected to the side wall, and the side frame is disposed around an edge of the back board;

wherein the side frame defines at least one gap, the back board defines a slot, and the slot and the at least one gap jointly define at least two radiation portions from the side frame; and wherein the first feed portion is electrically connected to one of the at least two radiation portions, the side wall is parallel to the at least two radiation portions, and the distance between the at least two radiation portions at different positions and the middle frame is the same; the side wall, the middle frame, the back board, and the side frame other than the at least two radiation portions are connected to each other to form a system ground plane to provide grounding for the antenna structure;

wherein the side frame comprises a second side portion, the side frame defines a first gap and a second gap, the side frame between the first gap and the second gap forms a first radiation portion, and the side frame between the first gap and the slot located at an end of the second side portion forms a second radiation portion;

wherein when the first feed portion feeds a current, the current flows through the first radiation portion toward to the first gap and the second radiation portion toward to the system ground plane to excite a second working mode generates a radiation signal in a second radiation frequency band.

2. The antenna structure of claim 1, further comprising a switch circuit, wherein one end of the switch circuit is electrically connected to the one of the at least two radiation portions, and another end of the switch circuit is electrically connected to the system ground plane.

3. The antenna structure of claim 2, wherein the switch circuit comprises a single switch, the single switch comprises a movable contact and a static contact, the movable contact of the single switch is electrically connected to the one of the at least two radiation portions, the static contact of the single switch is directly electrically connected to the system ground plane or electrically connected to the system ground plane through an impedance-matching component, and the impedance-matching component has a preset impedance.

4. The antenna structure of claim 2, wherein the switch circuit comprises a multiplexer switch, the multiplexer switch comprises a movable contact, a first static contact, a second static contact, a third static contact, and a fourth static contact, the movable contact is electrically connected to the one of the at least two radiation portions, the first static contact, the second static contact, and the third static contact are directly electrically connected to different positions of the system ground plane or electrically connected to the different positions of the system ground plane through an impedance-matching component, the fourth static contact is directly electrically connected to the system ground plane or suspended, and the impedance-matching component has a preset impedance.

5. The antenna structure of claim 2, wherein the side frame further comprises an end portion, and a first side portion, the first side portion and the second side portion are respectively connected to both ends of the end portion, the side wall is connected to the first side portion and the second side portion, a part of the side wall is parallel to the end portion, both ends of the side wall are L-shaped, the slot is defined on a side of the back board near the end portion and extends in a direction of the first side portion and the second side portion; wherein the first gap and the second gap are spaced apart on the side frame; wherein the first feed portion is electrically connected to the first radiation portion to feed a current to the first radiation portion and the second radiation portion, and the switch circuit is electrically connected to the first radiation portion.

6. The antenna structure of claim 5, wherein when the first feed portion feeds the current, the current flows through the first radiation portion toward to the second gap, and toward to the system ground plane to excite a first working mode and generates a radiation signal in a first radiation frequency band; and when the first feed portion feeds the current, the current flows through the second radiation portion toward to the system ground plane to excite a third working mode and generates a radiation signal in a third radiation frequency band; and wherein the frequency of the first radiation frequency band is less than the frequency of the second radiation frequency band, and the frequency of the second radiation frequency band is less than the frequency of the third radiation frequency band.

7. The antenna structure of claim 1, wherein a coupling distance between the middle frame and each of the at least two radiation portions is less than or equal to twice a width of the at least one gap.

8. A wireless communication device, comprising:

an antenna structure comprising:

a side wall;

a first feed portion; and a housing comprising a side frame, a middle frame, and a back board; wherein the middle frame and the back board are respectively connected to both sides of the side wall, and the middle frame and the back board are arranged in parallel; the middle frame is connected to the side wall, and the side frame is disposed around an edge of the back board;

wherein the side frame defines at least one gap, the back board defines a slot, and the slot and the at least one gap jointly define at least two radiation portions from the side frame; and wherein the first feed portion is electrically connected to one of the at least two radiation portions, the side wall is parallel to the at least two radiation portions, and the distance between the at least two radiation portions at different positions and the middle frame is the same; the side wall, the middle frame, the back board, and the side frame other than the at least two radiation portions are connected to each other, to form a system ground plane to provide grounding for the antenna structure;

wherein the side frame comprises a second side portion, the side frame defines a first gap and a second gap, the side frame between the first gap and the second gap forms a first radiation portion, and the side frame between the first gap and the slot located at an end of the second side portion forms a second radiation portion;

wherein when the first feed portion feeds a current, the current flows through the first radiation portion toward to the first gap and the second radiation portion toward to the system ground plane to excite a second working mode generates a radiation signal in a second radiation frequency band.

9. The wireless communication device of claim 8, wherein the antenna structure further comprises a switch circuit, one end of the switch circuit is electrically connected to the one of the at least two radiation portions, and another end of the switch circuit is electrically connected to the system ground plane.

10. The wireless communication device of claim 9, wherein the switch circuit comprises a single switch, the single switch comprises a movable contact and a static contact, the movable contact of the single switch is electrically connected to the one of the at least two radiation portions, the static contact of the single switch is directly electrically connected to the system ground plane or electrically connected to the system ground plane through an impedance-matching component, and the impedance-matching component has a preset impedance.

11. The wireless communication device of claim 9, wherein the switch circuit comprises a multiplexer switch, the multiplexer switch comprises a movable contact, a first static contact, a second static contact, a third static contact, and a fourth static contact, the movable contact is electrically connected to the one of the at least two radiation portions, the first static contact, the second static contact, and the third static contact are directly electrically connected to different positions of the system ground plane or electrically connected to the different positions of the system ground plane through an impedance-matching component, the fourth static contact is directly electrically connected to the system ground plane or suspended, and the impedance-matching component has a preset impedance.

12. The wireless communication device of claim 9, wherein the side frame further comprises at least one end portion, and a first side portion, the first side portion and the second side portion are respectively connected to both ends of the end portion, the side wall is connected to the first side portion and the second side portion, a part of the side wall is parallel to the end portion, both ends of the side wall are L-shaped, the slot is defined on a side of the back board near the at least one end portion and extends in a direction of the first side portion and the second side portion; wherein the first gap and the second gap are spaced apart on the side frame; wherein the first feed portion is electrically connected to the first radiation portion to feed a current to the first radiation portion and the second radiation portion, and the switch circuit is electrically connected to the first radiation portion.

13. The wireless communication device of claim 12, wherein when the first feed portion feeds a current, the current flows through the first radiation portion toward to the second gap, and toward to the system ground plane to excite a first working mode and generates a radiation signal in a first radiation frequency band; and when the first feed portion feeds the current, the current flows through the second radiation portion toward to the system ground plane to excite a third working mode and generates a radiation signal in a third radiation frequency band; and wherein the frequency of the first radiation frequency band is less than the frequency of the second radiation frequency band, and the frequency of the second radiation frequency band is less than the frequency of the third radiation frequency band.

14. The wireless communication device of claim 8, wherein a coupling distance between the middle frame and each of the at least two radiation portions is less than or equal to twice a width of the at least one gap.

15. An antenna structure, comprising:

a side wall;

a first feed portion; and a housing comprising a side frame, a middle frame, and a back board; wherein the middle frame and the back board are respectively connected to both sides of the side wall, and the middle frame and the back board are arranged in parallel; the middle frame is connected to the side wall, and the side frame is disposed around an edge of the back board;

wherein the side frame defines a first gap, a second gap, and a third gap, the back board defines a slot, and the slot and the at least one gap jointly define at least two radiation portions from the side frame; and wherein the first feed portion is electrically connected to one of the at least two radiation portions, the side wall is parallel to the at least two radiation portions, and the distance between the at least two radiation portions at different positions and the middle frame is the same; the side wall, the middle frame, the back board, and the side frame other than the at least two radiation portions are connected to each other to form a system ground plane to provide grounding for the antenna structure;

wherein the side frame comprises a first side portion, wherein the side frame between the first gap and the second gap forms a first radiation portion, the side frame between the first gap and the third gap forms a second radiation portion, and the side frame between the third gap and the slot located at an end of the first side portion forms a third radiation portion.

16. The antenna structure of claim 15, further comprising a switch circuit, wherein one end of the switch circuit is electrically connected to the one of the at least two radiation portions, and another end of the switch circuit is electrically connected to the system ground plane.

17. The antenna structure of claim 16, wherein the side frame further comprises an end portion, and a second side portion, the first side portion and the second side portion are respectively connected to both ends of the end portion, the side wall is connected to the first side portion and the second side portion, a part of the side wall is parallel to the end portion, the slot is defined on a side of the back board near the end portion and extends in a direction of the first side portion and the second side portion; wherein the first gap is defined on the end portion, the second gap is defined on the second side portion, and the third gap is defined on the first side portion; wherein the first feed portion is electrically connected to the first radiation portion to feed a current to the first radiation portion, the second radiation portion, and the third radiation portion, and the switch circuit is electrically connected to the first radiation portion.

18. The antenna structure of claim 17, wherein the antenna structure further comprises a ground portion, the ground portion is electrically connected to the second radiation portion for grounding; when the first feed portion feeds a current, the current flows through the first radiation portion toward to the second gap, and toward to the system ground plane to excite a first working mode and generates a radiation signal in a first radiation frequency band; when the first feed portion feeds the current, the current flows through the second radiation portion toward to the ground portion to excite a second working mode and generates a radiation signal in a second radiation frequency band; and when the first feed portion feeds the current, the current flows through the first radiation portion and the second radiation portion, the system ground plane, then flows into the first radiation portion to excite a third working mode and generates a radiation signal in a third radiation frequency band.

19. The antenna structure of claim 18, wherein the antenna structure further comprises a second feed portion and a third feed portion, the second feed portion is electrically connected to the second radiation portion to feed a current to the second radiation portion, the third feed portion is electrically connected to the third radiation portion to feed a current to the third radiation portion; wherein when the second feed portion feeds the current, the current flows through the second radiation portion to excite a fourth working mode and generate a radiation signal in a fourth radiation frequency band; when the third feed portion feeds the current, the current flows through the third radiation portion toward to the system ground plane to excite a fifth working mode and generate a radiated signal in a fifth radiated frequency band; wherein a part of the frequency of the fourth radiation frequency band overlaps with the frequency of the second radiation frequency band, and the frequency of the third radiation frequency band is less than the frequency of the fifth radiation frequency band.

* * * * *